US011281136B2

(12) United States Patent
Hirano

(10) Patent No.: US 11,281,136 B2
(45) Date of Patent: Mar. 22, 2022

(54) IMAGE FORMING APPARATUS HAVING A DELAYED IMAGE FORMING MODE

(71) Applicant: CANON KABUSHIKI KAISHA, Tokyo (JP)

(72) Inventor: Shigeru Hirano, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 54 days.

(21) Appl. No.: 16/529,889

(22) Filed: Aug. 2, 2019

(65) Prior Publication Data

US 2020/0050134 A1 Feb. 13, 2020

(30) Foreign Application Priority Data

Aug. 7, 2018 (JP) ..... JP2018-148171

(51) Int. Cl.
*G03G 15/20* (2006.01)
*G03G 15/00* (2006.01)
*G03G 15/16* (2006.01)

(52) U.S. Cl.
CPC ..... *G03G 15/205* (2013.01); *G03G 15/2039* (2013.01); *G03G 15/5083* (2013.01); *G03G 15/5087* (2013.01); *G03G 15/1665* (2013.01); *G03G 15/2053* (2013.01); *G03G 2215/1671* (2013.01)

(58) Field of Classification Search
CPC ..... G03G 15/205; G03G 15/2039; G03G 15/5083; G03G 15/5087
See application file for complete search history.

(56) References Cited

U.S. PATENT DOCUMENTS

2011/0142472 A1* 6/2011 Mitsuoka ..... G03G 15/2039 399/69
2012/0026524 A1* 2/2012 Sekido ..... G03G 15/5087 358/1.13

FOREIGN PATENT DOCUMENTS

JP 2010-211531 A 9/2010
JP 2017-077625 A 4/2017

* cited by examiner

*Primary Examiner* — Joseph S Wong
(74) *Attorney, Agent, or Firm* — Venable LLP

(57) ABSTRACT

An image forming apparatus includes a receiving portion to receive an image forming job signal for forming an image on a recording material, an image forming portion to form the image based on the received image forming job signal, and an image heating portion to heat the image, formed on the recording material by the image forming portion, in a nip where the recording material is nipped and fed. An inputting portion inputs a waiting time, and a controller performs an operation in an image forming mode so an image forming operation is not performed until a lapse of the input waiting time from the reception of the image forming job signal, and then the image forming operation is started based on the lapse of the waiting time in a stand-by state in which the image forming apparatus waits for reception of the image forming job signal.

8 Claims, 10 Drawing Sheets

IMAGE FORMING APPARATUS HAVING A DELAYED IMAGE FORMING MODE

FIELD OF THE INVENTION AND RELATED ART

The present invention relates to an image forming apparatus, capable of forming an image on a recording material, such as a copying machine, a printer, or a facsimile machine, employing an electrophotographic type, for example, and also relates to an information processing device (apparatus).

Conventionally, as the image forming apparatus employing the electrophotographic type, an image forming apparatus in which user authentication is performed for ensuring security and a job is not executed until a password is properly inputted by a user has been proposed (Japanese Laid-Open Patent Application (JP-A) 2010-211531). Specifically, printing is started in the case where as the user authentication, a valid (correct) password is inputted through an operating portion of the image forming apparatus before a print job is sent from an information processing device such as a PC or the like and then printing is made by executing the received print job information.

However, in the case where the user authentication is performed for ensuring security as in JP-A 2010-211531, there is a need that the image forming apparatus is provided with a device for performing the user authentication. Further, in the case where the image forming apparatus is not provided with the device for performing the user authentication, there is a possibility that an image-formed product is outputted immediately after the job is sent by a user from the information processing device remote from the image forming apparatus and then is erroneously taken by another user.

SUMMARY OF THE INVENTION

A principal object of the present invention is to provide an image forming apparatus capable of maintaining security with a simple constitution.

According to an aspect of the present invention, there is provided an image forming apparatus comprising: a receiving portion configured to receive a signal of an image forming job for forming an image on a recording material and a signal indicative of a time which are sent from an information processing device; an image forming portion configured to form the image on the recording material on the basis of the signal of the image forming job received by the receiving portion; an image heating portion configured to heat the image, formed on the recording material by the image forming portion, in a nip where the recording material is nipped and fed; and a controller configured to control an image forming operation so that the image forming operation is started after a lapse of the time from reception of the signal of the image forming job received by the image forming apparatus in a stand by state in which the image forming apparatus waits for the reception of the signal of the image forming job.

Further features of the present invention will become apparent from the following description of exemplary embodiments with reference to the attached drawings.

Figure 5:
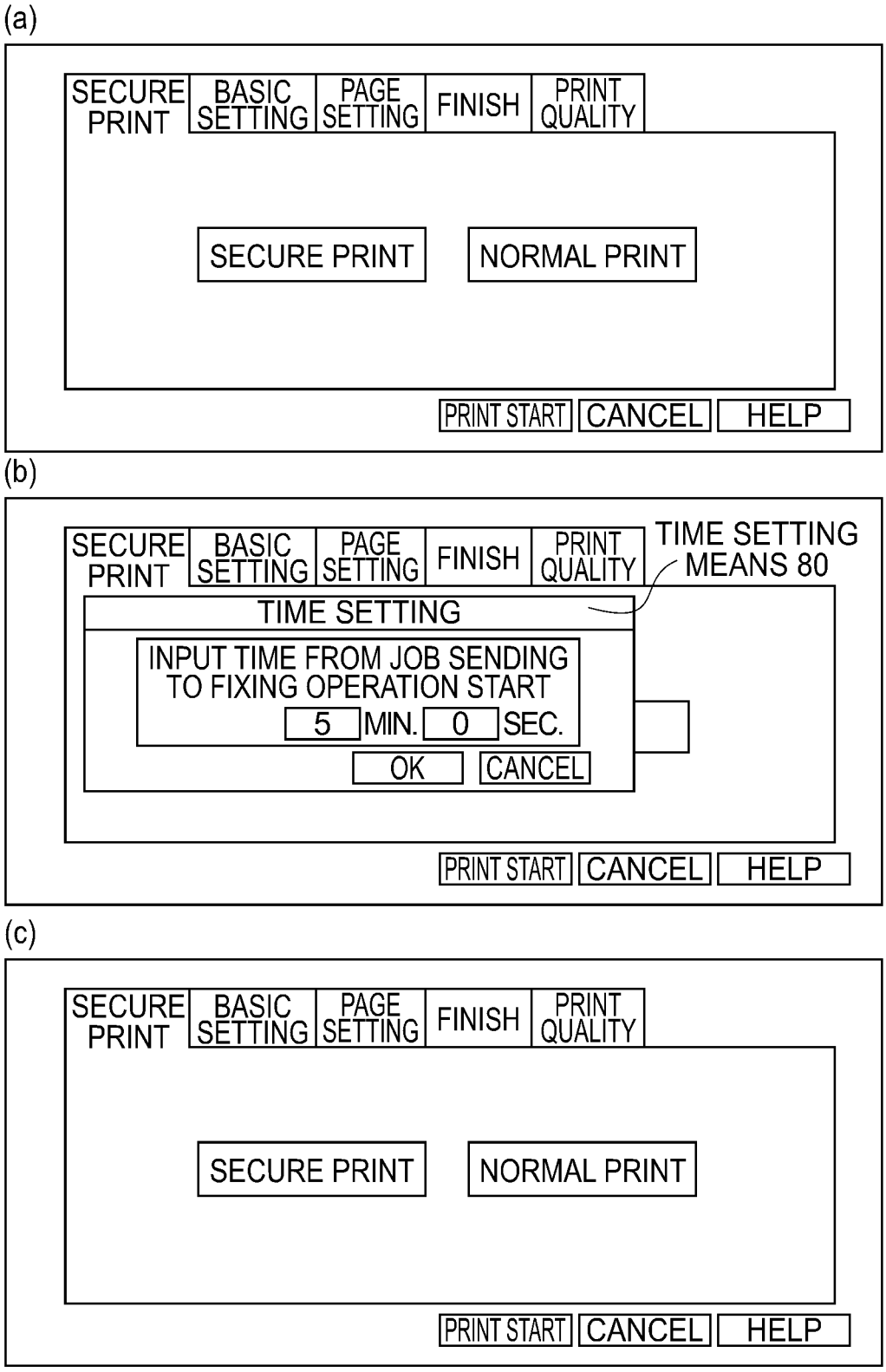

Part (a) of FIG. 5 is a print setting UI screen view (secure print) of the image forming apparatus in the First Embodiment, part (b) of FIG. 5 is a print setting UT screen view (time input) of the image forming apparatus in the First Embodiment, and part (c) of FIG. 5 is a print setting UI screen view (print start) of the image forming apparatus in the First Embodiment.

Figure 6:
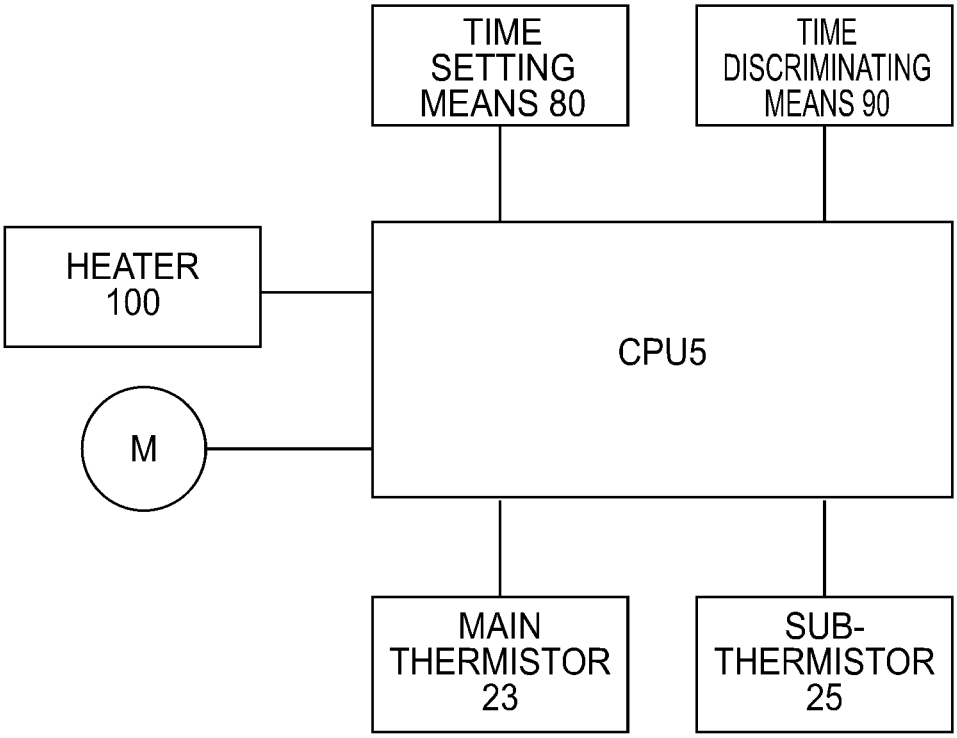

FIG. 6 is a block diagram of the image forming apparatus in the First Embodiment.

Figure 7:
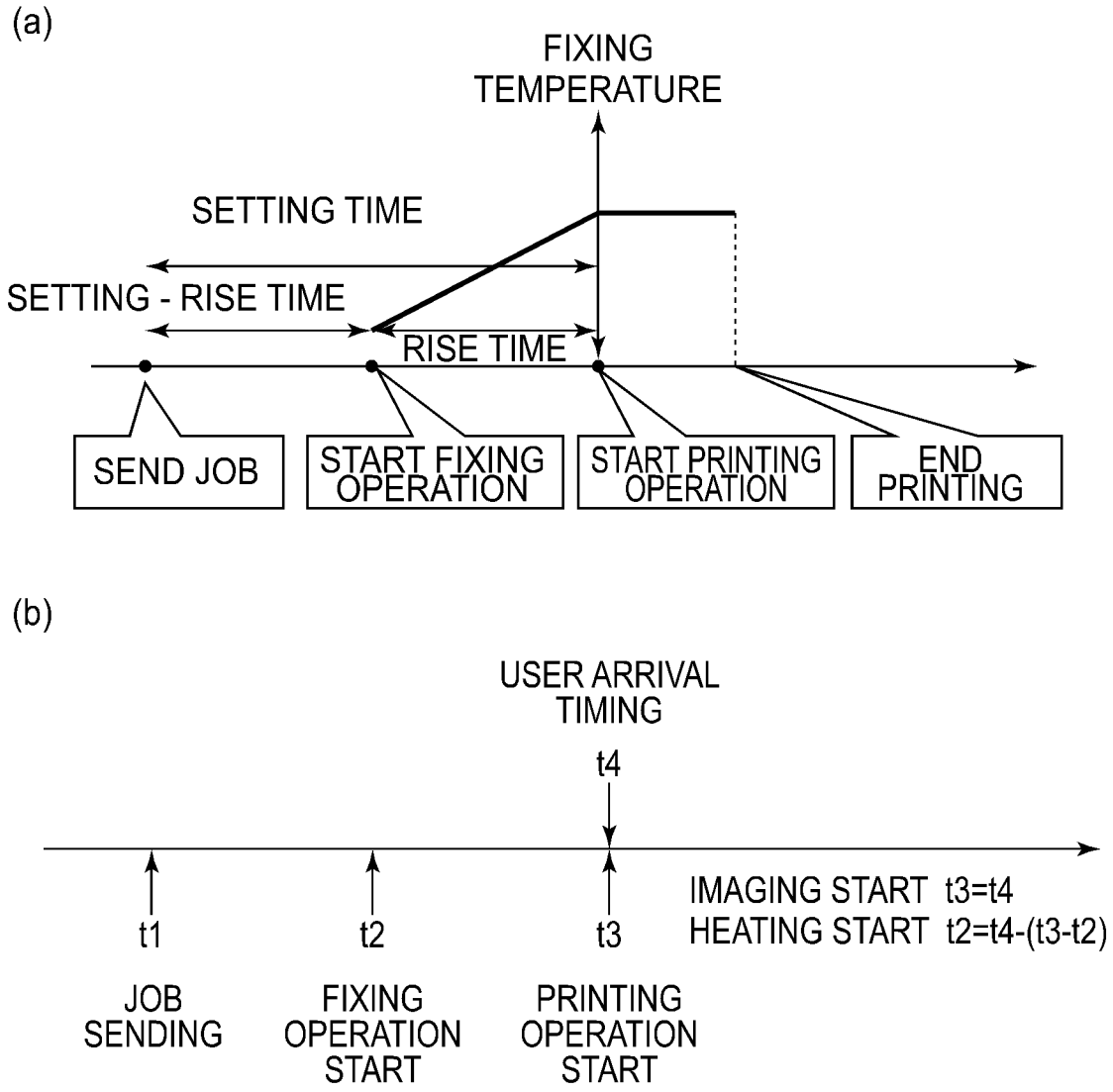

Parts (a) and (b) of FIG. 7 are temperature profiled diagrams during secure printing.

Figure 8:
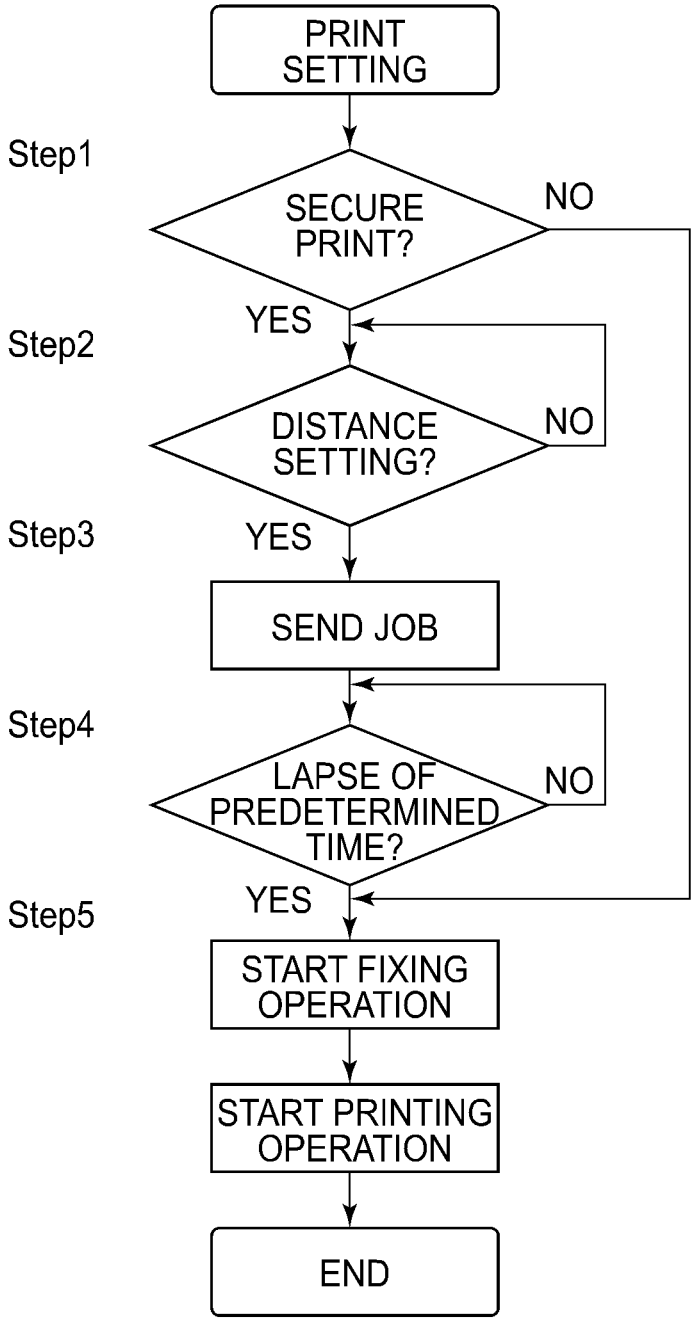

FIG. 8 is a flowchart showing a printing operation in the First Embodiment.

Figure 9:
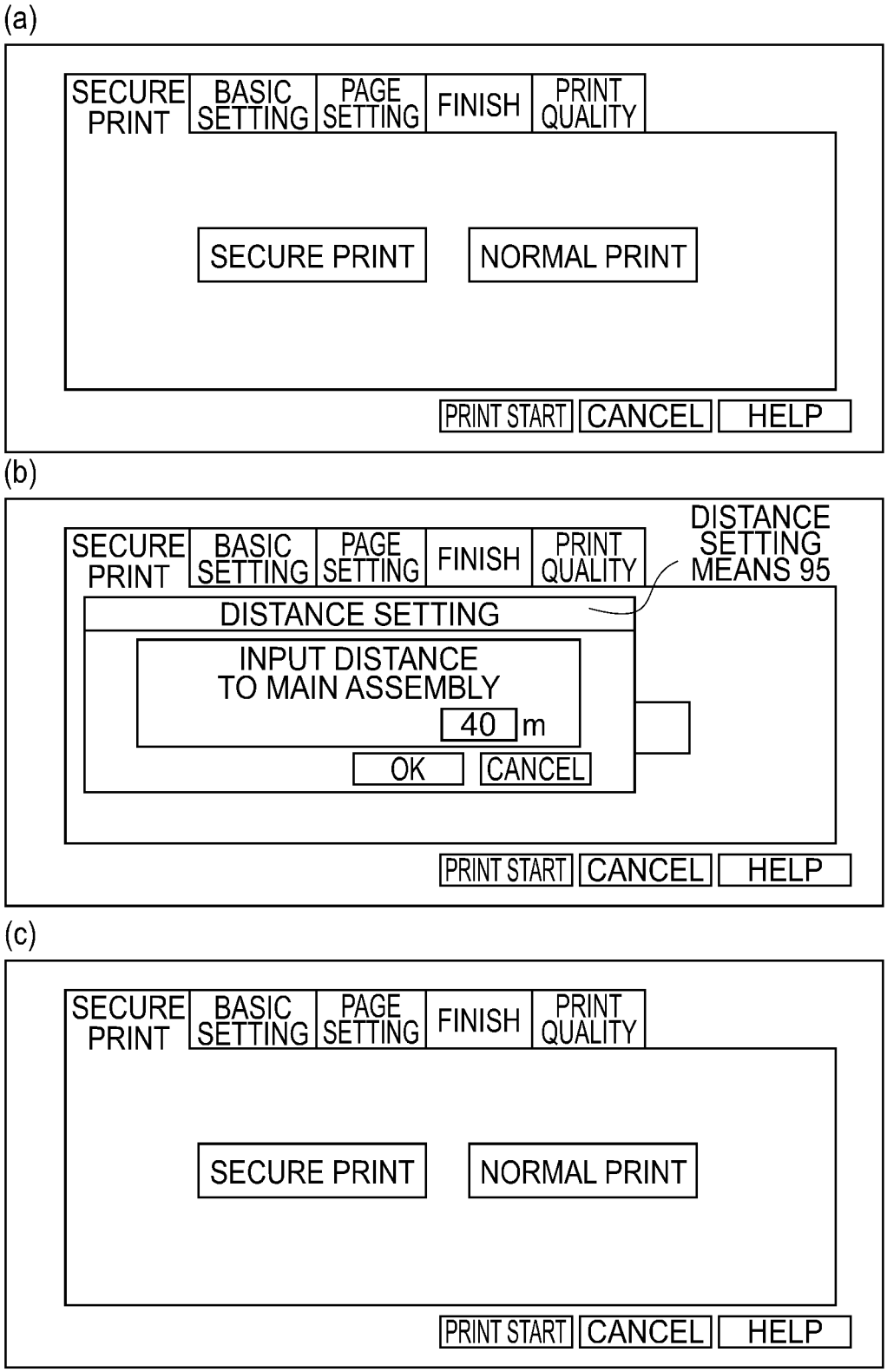

Part (a) of FIG. 9 is a print setting UI screen view (secure print) of the image forming apparatus in a Second Embodiment, part (b) of FIG. 9 is a print setting UT screen view (distance input) of the image forming apparatus in the Second Embodiment, and part (c) of FIG. 9 is a print setting UI screen view (print start) of the image forming apparatus in the Second Embodiment.

Figure 10:
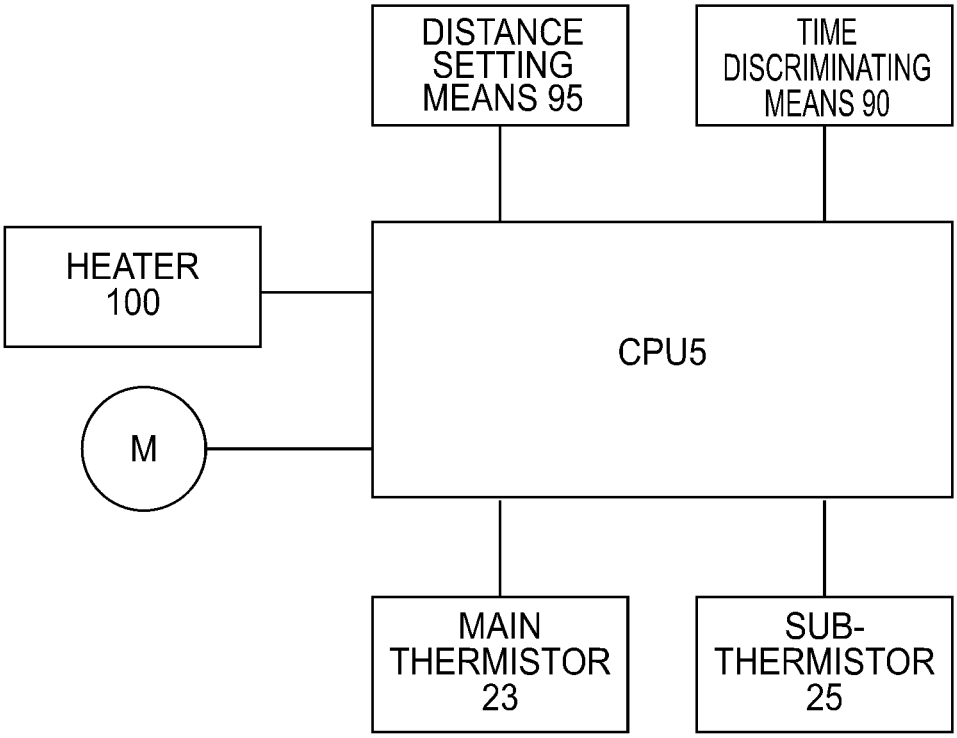

FIG. 10 is a block diagram of the image forming apparatus in the Second Embodiment.

DESCRIPTION OF EMBODIMENTS

In the following Embodiments of the present invention will be specifically described.

First Embodiment (Image Forming Apparatus)

Figure 1:
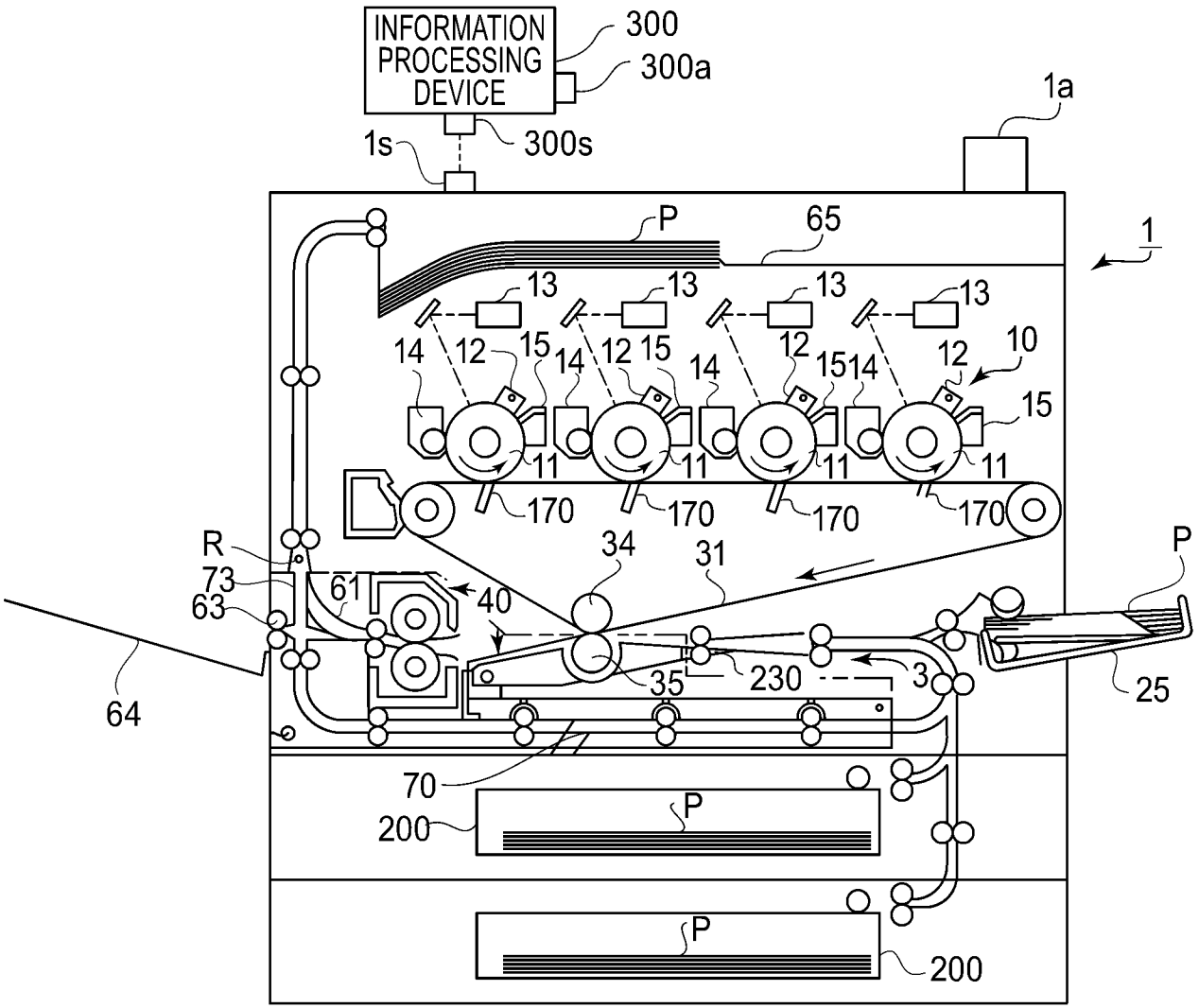
FIG. 1 is a schematic view for illustrating an image forming apparatus having an image heating device (apparatus) in an embodiment of the present invention.

FIG. 1 is a schematic sectional view of a color electrophotographic printer 1 which is an example of an image forming apparatus according to this embodiment, along a feeding direction of a recording material P (hereinafter, this printer is simply referred to as a "printer").

On the recording material P, a toner image is to be formed. Specific examples of the recording material P may include plain paper, a resin recording material which is a substitute for the plain paper, thick paper, a recording material for an overhead projector, and the like.

The printer 1 shown in FIG. 1 includes image forming portions of colors of Y (yellow), M (magenta), C (cyan) and Bk (black). A photosensitive drum 11 is electrically charged by a charger 12 in advance. Thereafter, on the photosensitive drum 11, a latent image is formed by a laser scanner 13. The latent image is developed into a toner image by a developing device 14. The toner images on the photosensitive drums 11 are successively transferred onto an intermediary transfer belt 31 which is an image bearing member, by primary transfer blades 170. After the transfer, toner remaining or the photosensitive drum 11 is removed by a cleaner 15. As a result, a surface of the photosensitive drum 11 is cleaned, and then the printer (image forming apparatus) 1 prepares for subsequent image formation.

On the other hand, the recording material P is sent one by one from a sheet (paper) feeding cassette 200 or a multi-sheet feeding tray 25 and is fed to a registration roller pair 230. The registration roller pair 230 once receives the recording material P, and in the case where the recording material P is obliquely fed, a feeding direction of the recording material P is corrected straight.

Then, the registration roller pair 230 sends the recording material P to between the intermediary transfer belt 31 and a secondary transfer roller 35 in synchronism with the (color) toner images on the intermediary transfer belt 31. The color toner images on the intermediary transfer belt 31 are transferred onto the recording material P by the secondary transfer roller 35 and a transferring member such as an inner secondary transfer roller 34. Thereafter, the toner images on the recording material P are fixed on the recording material P by heating and pressing the recording material P by a fixing device 40.

In the case where the toner image is formed on only one side (surface) of the recording material P, by switching a switching flapper 61, the recording material P is discharged onto a discharge tray 64 provided on a side surface of the image forming apparatus 1 through a discharging roller pair 63 or discharged onto a discharge tray 65 provided on an upper surface of the image forming apparatus 1. In the case where the switching flapper 61 is in a position of a broken line, the recording material P is discharged onto the discharge tray 64 in a face-up state (in which the toner image is on an upper side). Further, in the case where the switching flapper 61 is in a position of a solid line, the recording material P is discharged onto the discharge tray 65 in a face-down state (in which the toner image is on a lower side).

In the case where the toner images are formed on double sides (surfaces), the recording material P on which the toner image is fixed by the fixing device 40 is guided upward by the flapper 61 located in the position of the solid line. Then, when a trailing end of the recording material P reaches a reverse point R, the recording material P is turned upside down by being fed through a switch-back feeding path 73 in a switch-back manner. Thereafter, the recording material P is fed along a feeding path 70 for double-side image formation, and on which the toner image is formed on the other side (surface) in the same process as the process in one-side image formation, so that the recording material P is discharged onto the discharge tray 64 or the discharge tray 65. A portion constituted by the flapper 61, the switch-back feeding path 73 and the like is an example of reversing means.

In FIG. 1, an information processing device (apparatus) 300 such as a PC (personal computer) is provided remote from the image forming apparatus 1. The information processing device 300 includes a reception means 300*a* for receiving input of delay time information from a user described later and includes a sending means 300*s*. The image forming apparatus 1 includes a reception means 1*a* for receiving input of delay time information from the user and includes a receiving means 1*s* for receiving an image forming job and the delay time information described later for executing the image forming job. In this embodiment, as specifically described in an image forming operation described later, the delay time information from reception of the image forming job until the image forming operation (printing operation, print operation) starts is set (inputted) on the information processing device 300 by the user.

(Image Heating Device)

Next, the fixing device (fixing portion) 40 as an image heating device mounted in the image forming apparatus in this embodiment will be described. Here, with respect to members constituting the fixing device 40, a longitudinal direction is a direction perpendicular to a recording material feeding direction and a recording material thickness direction and corresponds to a widthwise direction of the recording material P. Further, a short-side direction is a direction perpendicular to the longitudinal direction and the recording material thickness direction and corresponds to the recording material feeding direction.

Figure 2:
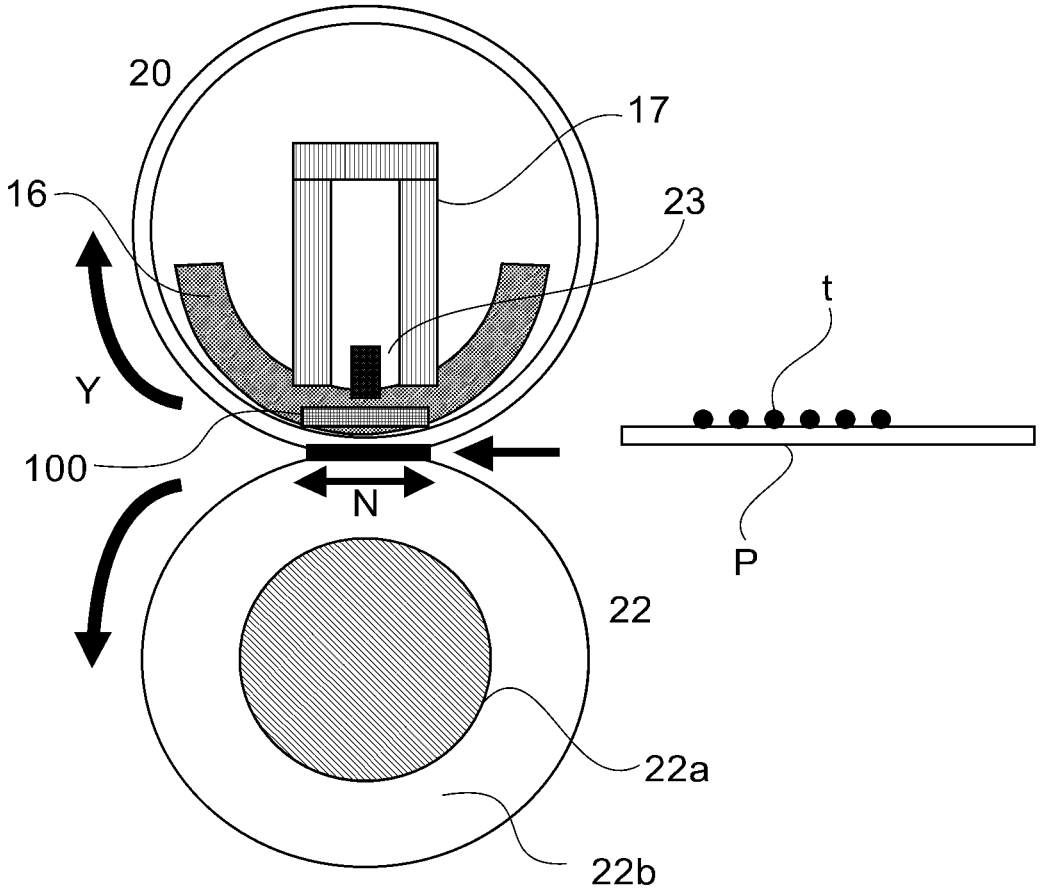
FIG. 2 is a schematic sectional vie of the first heating device with respect to a short-side direction.
Figure 3:
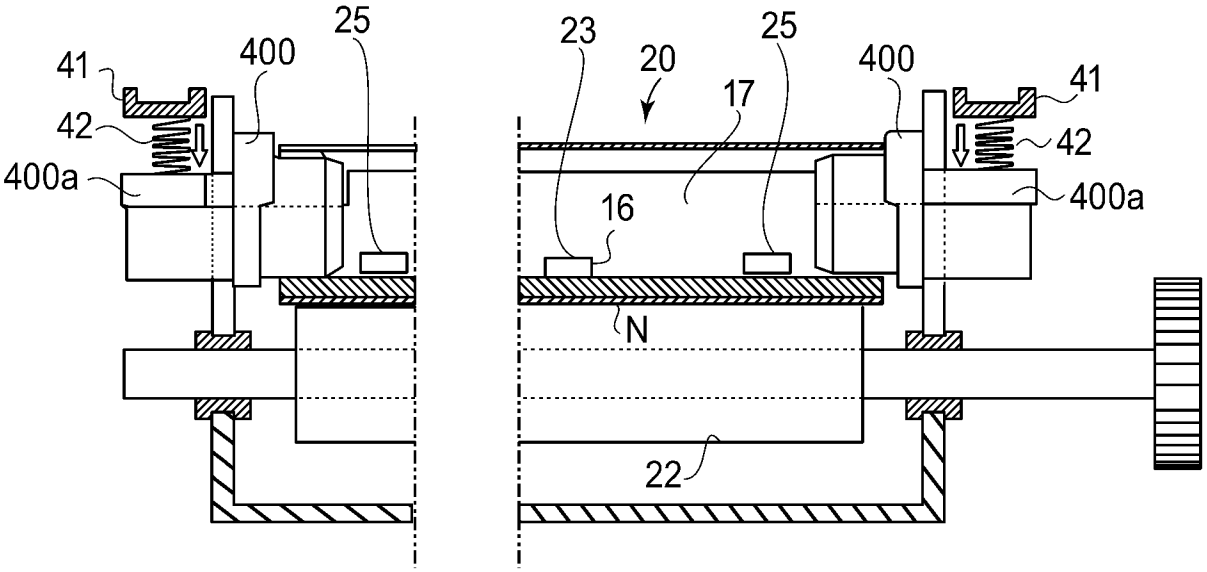
FIG. 3 is a schematic view for illustrating a structure of the image heating device.

FIG. 2 is a schematic sectional view of the fixing device 40 with respect to the short-side direction, and FIG. 3 is a schematic structural view of the fixing device 40. The fixing device 40 includes a cylindrical fixing belt (endless belt) 20 provided with a heat generating member and includes a pressing roller 22 for forming a fixing nip between itself and the fixing belt 20.

The fixing device 40 shown in FIG. 3 includes left and right fixing flanges 400 as regulating members for regulating movement of the fixing belt 20 in the longitudinal direction and a shape of the fixing belt 20 with respect to a circumferential direction. The fixing device further includes a supporting stay 17 provided inside the fixing belt 20 and the supporting stay 17 supports a back-up member 16 for pressing and urging the fixing belt 20 in a direction toward the pressing roller 22.

The fixing belt 20 is loosely fitted (coated) on an outer surface of the back-up member 16. Further, outer extended arm portions of the supporting stay 17 on left and right sides (opposite end sides with respect to the longitudinal direction) engage with the left and right flanges 400, respectively. Further, between each of left and right pressing arms 41 and associated one of pressing portions 400*a* of the left and right flanges 400, a pressing spring 42 is compressedly provided. As a result, the fixing belt 20 is pressed against an upper surface of the pressing roller 22 with predetermined pressure via the left and right fixing flanges 400, the supporting stay 17 and the back-up member 16, so that the nip N having a predetermined width is formed. The pressure in this embodiment is 156.8 N on one side, and a total pressure is 313.6 N (32 kgf).

The supporting stay 17 may desirably be formed of a material which is not readily flexed even when high pressure is applied thereto, and is formed of SUS 304 in this embodiment.

The fixing belt 20 shown in FIG. 2 includes a ceramic heater 100 as a heat generating member. This heater 100 has a basic structure including a thin elongated ceramic substrate extending in a longitudinal direction perpendicular to the drawing sheet (FIG. 2) and including an energization heat generating resistor layer provided on a surface of this substrate, and is a low heat-capacity heater increasing in temperature with an abrupt rising property as a whole by energization to the heat generating resistor layer. In this embodiment, the heat generating resistor layer is formed on the ceramic substrate of 600 μm in thickness.

The back-up member 16 is a nip forming member on which the heater 100 is fixedly supported. The back-up member 16 has a substantially semicircular trough shape in cross-section and is a heat-insulating member formed of a heat-resistant resin material. From the viewpoint of energy saving, a material with a small degree of heat conduction to the supporting stay 17 may desirably be used, and for example, heat-resistant glass or a heat-resistant resin material such as polycarbonate or a liquid crystal polymer is used.

In this embodiment, a heat-resistant resin material ("SUMIKASUPER E5204L", manufactured by Sumitomo Chemical Co.) was used. The heater 100 is engaged in a groove, formed and provided on a lower surface of the back-up member 16 along the longitudinal direction, in a state in which a front surface side of the heater 100 is exposed downward, and then is fixed with a heat-resistant adhesive or the like.

The pressing roller 22 has a multi-layer structure in which a core metal of stainless steel, an about 3 mm-thick silicone rubber layer and an about 50 μm-thick PFA rein tube are successively laminated in a named order. Opposite end portions of the core metal of this pressing roller 22 with respect to the longitudinal direction are shaft-supported rotatably between unshown rear and front side plates.

In FIG. 3, a main thermistor 23 and a sub-thermistor 25 which are temperature detecting means are provided. The main thermistor 23 and the sub-thermistor 25 are contacted to the ceramic heater 100 on a side opposite from the nip N and are disposed at positions of 35 mm and 146 mm, respectively, from a sheet feeding reference center (line) with respect to the longitudinal direction.

The main thermistor 23 and the sub-thermistor 25 are connected to a control circuit portion (CPU 5) as a control means provided in the image forming apparatus 1 or the fixing device 40 as the first heating device via an unshown A/D converter. This control circuit portion samples output from the thermistor in a predetermined cyclic period, and reflects acquired temperature information on energization. That is, the control circuit portion determines control contents of the energization to the heater 100 on the basis of the outputs of the main thermistor 23 and the sub-thermistor 25, and controls electric power supplied from a power source portion to the heater 100.

The fixing belt 20 is prepared by forming an elastic layer of a rubber material with high thermal conductivity on a metal layer having a high thermal conductivity and a high tension strength and then by forming on the surface of the elastic layer, and a parting layer of a fluorine-containing resin material so that a resultant fixing belt has an endless shape of 25 mm in inner diameter. The metal layer is formed of a stainless steel material in a thickness of 50 μm, the elastic layer is a silicone rubber of 1.0 W/m·K in thermal conductivity, and the parting layer is a tube of tetrafluoroethylene-perfluoroalkylvinyl ether copolymer (hereinafter referred to as PFA) formed in a thickness of 20 μm.

The pressing roller 22 is prepared by forming a flexible elastic layer of a rubber material on an outer surface of a cylindrical shaft member formed of iron, aluminum or the like. On the surface of the elastic layer of the pressing roller 22, a parting layer of a PFA tube so that the pressing roller 22 has an outer diameter of 25 mm. The shaft member is an aluminum tube of 10 mm in outer diameter and 3 mm in thickness, and the elastic layer is a 3 mm-thick silicone rubber of 64° in Asker hardness. The PFA tube is 50 μm in thickness. The pressing roller 22 is rotationally driven at a predetermined peripheral speed in an arrow direction. The fixing belt 20 in a press-contact relationship with this pressing roller 22 is driven by the pressing roller 22 and is rotated at the same speed as the speed of the pressing roller 22.

Onto an inner surface of the fixing belt 20, grease is applied, so that abrasion of the inner surface of the fixing belt 20 generated due to friction between the back-up member 16 and the inner surface of the fixing belt 20 is reduced.

When the pressing roller 22 is rotationally driven and the fixing belt 20 is rotated correspondingly by the rotational drive of the pressing roller 22, energization to the heat generating layer of the heater 100 is carried out. Then, the temperature of the fixing belt 20 rises to a set temperature, and the recording material P carrying thereon the toner image is introduced into the nip N.

In the nip N, the toner image carrying surface of the recording material P intimately contacts the outer surface of the fixing belt 20, and the recording material P moves together with the fixing belt 20. In a nip-feeding process in the nip N, heat generating in the heat generating layer of the heater 100 is imparted to the recording material P, so that an unfixed toner image t is melted and fixed on the recording material P. The recording material P passed through the nip N is curvature-separated from the fixing belt 20 and then is discharged.

(Image Forming Operation)

Figure 4:
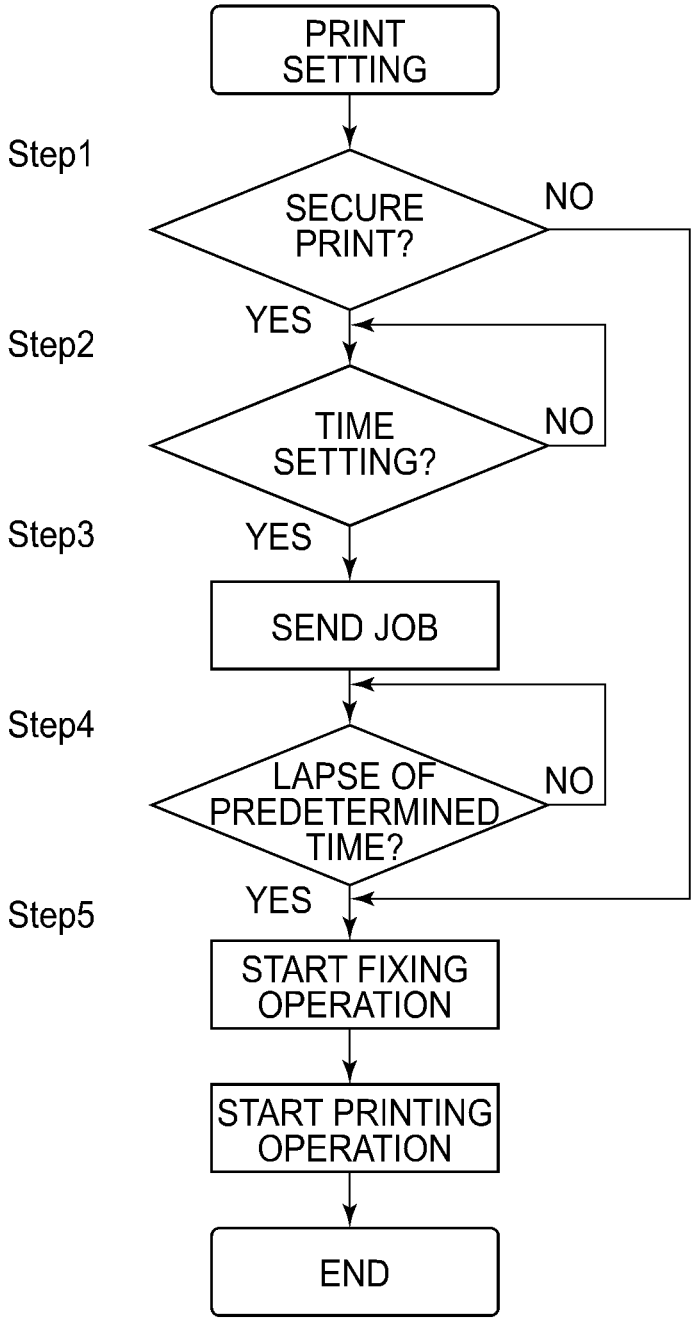
FIG. 4 is a flowchart showing a printing operation in a First Embodiment.

FIG. 4 is a flowchart showing a flow of a series of operations from sending of a job on the information processing device by the user until the image forming operation (printing operation, print operation) starts in this embodiment. In this embodiment, the information processing device is an information processing device such as a personal computer fixedly installed at a place remote from the image forming apparatus main assembly. In this embodiment, delay time information from the sending of the job to the start of the image forming operation (the start of the printing operation) is set on the information processing device by the user. Then, not only the image forming operation start (printing operation start) is made a time of a lapse of a predetermined delay time but also an image heating operation start (fixing operation start) is made in advance of the image forming operation start (printing operation start). In this embodiment, the printing operation start is an earlier one of a start of feeding of the recording material and a start of an image writing operation with a laser.

In this embodiment, as the case where after the user sends the job through an arbitrary place and the job reaches the image forming apparatus 1 after a lapse of 5 minutes from the sending, the case where a signal time from the job sending to the printing operation start is set at 5 minutes by a time setting means 80 shown in FIG. 6 will be described.

Step 1: In a print setting UI screen shown in part (a) of FIG. 5, the user selects whether print is secure print in which security is ensured or normal print in which security is not ensured. That is, a secure print mode is a first image forming mode in which the image forming operation is started after a lapse of an inputted time from input of a signal of an image forming job, and a normal print mode is a second image forming mode in which the image forming operation is started at predetermined timing after the image forming job signal is inputted. When the print is the secure print, the sequence goes to Step 2, and when the print is the normal print, the sequence goes to Step 5.

Step 2: In a print setting UI screen shown in part (b) of FIG. 5, the time from the job sending to the printing operation start is inputted by the user, so that the time from the job sending to the printing operation start is set in a controller shown in FIG. 6 by the time setting means 80 in the controller shown in FIG. 6. In this embodiment, the time from the job sending to the printing operation start (image formation start) is set at 5 minutes.

Step 3: In a print setting UI screen shown in part (c) of FIG. 5, the job is sent by "print start" of "secure print".

Step 4: In the controller (FIG. 6) of the image forming apparatus 1, as regards the time set by the time setting means 80, CPU 5 measures an elapsed time from the job sending, and a time discriminating means 90 discriminates whether or not the set time has passed. Then, the user goes from a place where the information processing device 300 is installed to a place where the image forming apparatus 1 is installed.

Step 5: When as the set time, 5 minutes has passed from the job sending, the printing operation is started. At this time, the user arrives at the image forming apparatus 1.

Further, as shown in part (b) of FIG. 7, the fixing device 40 is not only constituted so that the printing operation can be started when the user arrives at the image forming apparatus (t3=t4) but also starts the fixing operation in advance (t2=t4−(t3−t2)). In part (b) of FIG. 7, t1 is job sending timing, t2 is fixing operation (first heating operation) start timing, t3 is printing operation (image forming operation) start timing, and t4 is user arrival timing.

Here, in general, as regards the fixing device 40, a temperature thereof during the fixing operation start (first heating start) varies depending on an operation (use) frequency, an operation history and operation timing, and therefore, a fixing rise time until the temperature of the fixing device 40 reaches an image formable temperature (for example, 200° C.). For example, in the case where the fixing device 40 starts a fixing actuation operation from a room temperature, it takes 10 seconds until the fixing device temperature reaches the image formable temperature (for example, 200° C.).

On the other hand, in the case where the fixing actuation operation is started immediately after 500 sheets of recording materials of 80 g in basis weight are continuously passed through the fixing device 40, a main thermistor temperature T at a time of a start of a fixing operation is 170° C., and therefore, it takes 2 seconds until the fixing device temperature reaches the image formable temperature (for example, 200° C.).

Therefore, depending on the main thermistor temperature T before the start of the fixing operation (for example, after a lapse of 1 second as a predetermined time from the job sending), as shown in the following Table 1, a state of the fixing device 40 is divided into six states (hereinafter, referred to as warming-up states). Further, depending on the warming-up state, it also becomes possible to change the fixing rise time (time from a start of heating of the first heating portion until the fixing device temperature reaches a temperature necessary to fix the image). As result, it is possible to suppress unnecessary idling of the fixing device 40.

TABLE 1

| WUS*1 | 0 | 1 | 2 | 3 | 4 | 5 |
|---|---|---|---|---|---|---|
| MTT*2 | T ≤ 40 | 40 < T ≤ 80 | 80 < T ≤ 100 | 100 < T ≤ 120 | 120 < T ≤ 140 | 140 < T |
| FRT*3 | 10 sec. | 8 sec. | 6 sec. | 4 sec. | 3 sec. | 2 sec. |

*1"WUS" is the warming-up state.
*2"MTT* is the main thermistor temperature T (° C.).
*3"FRT" is the fixing rise time.

Thus, the time from the job sending to the printing operation start is made settable correspondingly to the user arrival time from the information processing device to the image forming apparatus, whereby it is possible to maintain security of a print by a simple constitution without providing an authentication device. Further, as a result, a waiting time of the user in the first heating is suppressed, so that electric power consumption can also be suppressed.

Different from this embodiment, in an image forming apparatus in which the authentication device is not provided and in which time setting or distance setting cannot be made, the printing operation is started with the job sending as a trigger. For this reason, there is a liability that a printed product is seen by another person (other than the user) until the user arrives at the image forming apparatus, so that security cannot be maintained.

In this embodiment, an example in which the time from the job sending until the user arrives at the image forming apparatus 1 is inputted (set in advance) by the user was described. However, the present invention is not limited thereto, but it is also possible that the time from the job sending until the user arrives at the image forming apparatus 1 is stored by the CPU 5 as a control means provided in the image forming apparatus 1 and then the printing operation is started correspondingly to last history information.

Second Embodiment

In this embodiment, in place of the input of the time from the information processing device to the image forming apparatus (apparatus main assembly), a distance from the information processing device to the image forming apparatus (apparatus main assembly) is inputted. Then, as shown in FIG. 10, as a controller of the image forming apparatus, a distance setting means 95 acquires information on the distance from the information processing device to the image forming apparatus (apparatus main assembly) in the controller. Then, on the basis of the distance from the information processing device to the image forming apparatus (apparatus main assembly) and a user walking speed, a time from the job sending via the information processing device by the user until the user arrives at the image forming apparatus (apparatus main assembly) is acquired. Other points are the same as those in the First Embodiment and will be omitted from description.

FIG. 8 is a flowchart showing a flow of a series of operations from the job sending on the information processing device to a start of the printing operation in this embodiment. In this embodiment, for example, the case where the distance from the information processing device to the image forming apparatus 1 was 40 m (part (b) of FIG. 9) will be described. Here, assuming that the user walking speed is 80 m/min., the time until the user arrives at the image forming apparatus 1 after departing from the information processing device is 30 seconds as a division time obtained by dividing the inputted distance by the user walking speed. Step 1: In a print setting UI screen shown in part (a) of FIG. 9, whether the print is the secure print or the normal print is selected. When the print is the secure print, the sequence goes to Step 2 of FIG. 8, and when the print is the normal print, the sequence goes to Step 5. Step 5: When 30 seconds elapses from the job sending, the printing operation is started. At this time, the user arrives at the image forming apparatus 1. Further, the fixing device 40 starts the fixing operation in advance so that the fixing operation can be started when the user arrives at the image forming apparatus 1 as shown in parts (a) and (b) of FIG. 7. Further, as shown in Table 1, the fixing rise time varies depending on the warming-up state of the fixing device 40, and therefore, start timing of the fixing operation may preferably be changed depending on the warming-up state. As a result, unnecessary idling of the fixing device 40 can be suppressed.

Thus, according to this embodiment, by inputting the distance from the information processing device to the image forming apparatus 1, the user arrival time is calculated depending on the distance inputted by the user, so that the printing operation is started at timing when the user arrives at the image forming apparatus 1. As a result, the image forming apparatus 1 is capable of maintaining security of a distance by a simple constitution without providing an authentication device. Further, as a result, a waiting time of the user in first heating is suppressed, and it is also possible to suppress electric power consumption.

In this embodiment, an example in which the distance from the information processing device to the image forming apparatus 1 is inputted (set in advance) by the user was described. However, the present invention is not limited thereto, but it is also possible that the distance from the information processing device to the image forming apparatus 1 is stored by the CPU 5 and then the printing operation is started correspondingly to the last history information.

MODIFIED EMBODIMENTS

In the above-described embodiments, preferred embodiments of the present invention were described, but the present invention is not limited thereto. The present invention can be variously modified within the scope of the present invention.

Modified Embodiment 1

In the above-described embodiments, the case where the image forming apparatus 1 is provided with the receiving means for receiving, from the information processing device, the delay time information for executing the image forming job or provided with the storing means for storing the delay time information for executing the image forming job was described. However, the present invention is not limited thereto but may also be an image forming apparatus provided with an operating portion as a reception means for receiving, from the user, the delay time information for executing the image forming job.

Further, in the above-described embodiments, the case where the information processing device is provided with the receiving means for receiving, from the user, the delay time information for executing the image forming job was described, but the information processing device may also be provided with a storing means for storing the delay time information for executing the image forming job.

In either case, the image forming apparatus executes the image forming job when a first time as a predetermined delay time relating to the delay time information has elapsed from the time of reception of the image forming job. Then, the image forming apparatus causes the first heating portion to start the first heating when a second time shorter than the first time has a lapsed from the reception of the image forming job. As a result, security is maintained without performing the user authentication, so that a waiting time of the user in first heating can be suppressed.

Modified Embodiment 2

In the above-described embodiments, the case where the fixing device 40 is of the fixing type including the endless belt was described as an example, but the present invention is not limited thereto. The type of the fixing device is not uniquely determined by the constitution or the like of the fixing device.

Further, as regards the warming-up state, description was made using the main thermistor temperature before the start of the fixing operation as an example, but a similar effect can be achieved also by defining the warming-up state by an operation history (temperature/sheet feeding mode/time or the like) from the last job.

Modified Embodiment 3

In the above-described embodiments, as regards the input of the arrival time or the arrival distance from the information processing device to the image forming apparatus, various forms would be considered. The input may also be carried out via a network from user PC, or the arrival time or distance may also be made settable in advance without via the network for each of user PCs. Further, when the user sends the job on his (her) PC, the arrival time or distance may also be made inputtable for each of the jobs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148171 filed on Aug. 7, 2018, which is hereby incorporated by reference herein in its entirety.

What is claimed is:

1. An image forming apparatus comprising:

a receiving portion configured to receive a signal of an image forming job for forming an image on a recording material;

an image forming portion configured to form the image on the recording material on the basis of the signal of the image forming job received by said receiving portion;

an image heating portion configured to heat the image, formed on the recording material by said image forming portion, in a nip where the recording material is nipped and fed;

an inputting portion configured to input a waiting time; and a controller configured to perform an operation in an image forming mode so that an image forming operation is not performed until a lapse of the waiting time inputted from said inputting portion from the reception of the signal of the image forming job, and then the image forming operation is started based on the lapse of the waiting time from reception of the signal of the image forming job in a stand-by state in which said image forming apparatus waits for the reception of the signal of the image forming job, wherein said controller causes the image heating portion to start a heating operation of said heating portion when a set time elapses after receiving the signal of the image forming job, and the set time is set according to the stand-by state and is shorter than the waiting time.

2. An image forming apparatus according to claim 1, wherein the image forming mode is a first image forming mode, and wherein said controller is capable of performing the operation in a second image forming mode in which the image forming operation is started based on the reception of the signal of the image forming job irrespective of the waiting time inputted from said inputting portion.

3. An image forming apparatus according to claim 1, wherein said image heating portion includes a rotatable image heating member configured to heat the image, a heating portion configured to heat said image heating member, and a temperature detecting portion configured to detect at least one of said image bearing member and said heating portion.

4. An image forming apparatus according to claim 1, further comprising a storing portion configured to store the waiting time which is received by said receiving portion.

5. An image forming apparatus according to claim 1, further comprising an image bearing member and an electrostatic latent image forming portion configured to form an electrostatic latent image on said image bearing member, wherein a start of the image forming operation is a time of starting formation of the electrostatic latent image on said image bearing member.

6. An image forming apparatus according to claim 1, wherein a start of the image forming operation is a time of starting feeding of the recording material.

7. An image forming apparatus according to claim 2, wherein said input portion is configured to manually input a setting instruction for executing the image forming job in the first image forming mode or the second image forming mode.

8. An image forming apparatus according to claim 1, wherein said image heating portion includes a planar heater and a belt contacting an inner surface of said heater, and wherein the image on the recording material is heated by heat via said belt.

* * * * *